US011965322B2

(12) United States Patent
Lambert et al.

(10) Patent No.: US 11,965,322 B2
(45) Date of Patent: Apr. 23, 2024

(54) FLUSH TOILET

(71) Applicant: Kohler Co., Kohler, WI (US)

(72) Inventors: Tony L. Lambert, Sheboygan, WI (US); Daniel N. Halloran, Fredonia, WI (US); Andrew L. Smith, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 251 days.

(21) Appl. No.: 16/582,616

(22) Filed: Sep. 25, 2019

(65) Prior Publication Data

US 2020/0102729 A1 Apr. 2, 2020

Related U.S. Application Data

(60) Provisional application No. 62/738,428, filed on Sep. 28, 2018.

(51) Int. Cl.
*E03D 11/08* (2006.01)
*E03D 11/13* (2006.01)

(52) U.S. Cl.
CPC ..... *E03D 11/08* (2013.01); *E03D 11/13* (2013.01); *E03D 2201/40* (2013.01)

(58) Field of Classification Search
CPC ..... E03D 11/08; E03D 11/13; E03D 2201/40
USPC ..... 4/420
See application file for complete search history.

(56) References Cited

U.S. PATENT DOCUMENTS 3,601,820 A 8/1971 Sargent et al.
6,367,095 B2 * 4/2002 Hubatka ..... E03D 5/00 4/354
7,111,333 B1 * 9/2006 Lo ..... E03D 11/06 4/420
7,661,153 B2 2/2010 Nakamura et al.
7,827,628 B2 * 11/2010 Ichiki ..... E03D 11/08 4/420
9,260,852 B2 2/2016 Wu et al.
9,353,512 B2 * 5/2016 McHale ..... E03D 11/08
(Continued)

FOREIGN PATENT DOCUMENTS

CN 102953422 A 3/2013
CN 202936874 U 5/2013
CN 104854283 A 8/2015
CN 104912169 A * 9/2015
(Continued)

OTHER PUBLICATIONS

CN-104912169-A Translation (Year: 2021).*
(Continued)

*Primary Examiner* — David P Angwin
*Assistant Examiner* — William R Klotz
(74) *Attorney, Agent, or Firm* — Lempia Summerfield Katz LLC

(57) ABSTRACT

A toilet includes an inlet structure, a bowl structure, and an outlet structure. The inlet structure is configured to receive water. The bowl structure has a toilet bowl including a rim and a sump, a split fluidly connected to the inlet structure and including a first passage and a second passage, a shelf located below the rim of the toilet bowl and fluidly connected to the first passage, a side channel fluidly connected to the second passage, and a diverter that redirects the water from the side channel to the sump of the toilet bowl. The outlet structure is fluidly connected to the sump and is configured to discharge water from the sump into a drain.

15 Claims, 8 Drawing Sheets

(56) References Cited

U.S. PATENT DOCUMENTS

| | | | | |
|---|---|---|---|---|
| 10,077,547 | B2 | 9/2018 | Kashirajima et al. | |
| 10,246,865 | B2 | 4/2019 | Grover et al. | |
| 10,370,839 | B2 * | 8/2019 | Kashirajima | E03D 11/06 |
| 10,378,195 | B2 | 8/2019 | Urata et al. | |
| 10,648,164 | B2 * | 5/2020 | Yamasaki | E03D 11/08 |
| 2003/0115664 | A1 | 6/2003 | Kosugi et al. | |
| 2003/0140406 | A1 * | 7/2003 | Miwa | E03D 11/08 4/420 |
| 2009/0241250 | A1 * | 10/2009 | Grover | E03D 11/08 4/425 |
| 2015/0275494 | A1 * | 10/2015 | Kashirajima | E03D 11/02 4/420 |
| 2018/0155913 | A1 * | 6/2018 | Kashirajima | E03D 11/08 |
| 2020/0095756 | A1 * | 3/2020 | Shiohara | E03D 11/08 |
| 2022/0412065 | A1 * | 12/2022 | Jiang | E03D 1/38 |

FOREIGN PATENT DOCUMENTS

| | | | | |
|---|---|---|---|---|
| CN | 104912169 | A | | 9/2015 |
| CN | 205954789 | U | * | 2/2017 |
| CN | 205954789 | U | | 2/2017 |
| CN | 207633456 | U | | 7/2018 |
| JP | 2004011414 | A | | 1/2004 |
| JP | 2011012508 | A | | 1/2011 |

OTHER PUBLICATIONS

CN-205954789-U Translation (Year: 2021).*

Chinese Office Action for Chinese Application No. 201910931103.9 dated Aug. 25, 2020.

Chinese Office Action for Chinese Application No. 201910931103.9 dated Mar. 23, 2021.

* cited by examiner

FLUSH TOILET

CROSS-REFERENCE TO RELATED APPLICATIONS

This application claims the benefit of and priority to U.S. Provisional Application No. 62/738,428, filed Sep. 28, 2018, the entire disclosure of which is hereby incorporated by reference herein.

BACKGROUND

The present application relates generally to the field of toilets. More specifically, this application relates to toilets having a flush structure that improves the overall flush efficiency of the toilet.

There is a constant desire and need within the field of toilets (and other water using devices) to become ever more efficient and use less water, such as during each flush cycle, much like the ever increasing desire to improve fuel efficiency of internal combustion engines. Also similar to slight improvements in fuel efficiency in engines, even a slight improvement in flush efficiency for toilets can have a monumental impact on water conservation (i.e., reduction of water consumption) given the number of toilets and flush cycles used daily (not just in the U.S., but on a global scale). Thus, there is constant pressure to find new ways to improve flush efficiency, even if only a slight improvement is recognized. Despite this constant pressure to increase flush efficiency and decrease water consumption, such improvements are easier said than done.

Further, providing a proper flush in which all of the contents (e.g., solid waste, liquid waste, etc.) in the toilet bowl are removed from the toilet bowl during a single flush cycle is a competing interest to increasing flush efficiency and decreasing water usage. Current toilets aimed at using one gallon of water per flush provide poor overall flush performance (e.g., leaving contents in the toilet bowl following the first flush), which results in customer dissatisfaction and often additional flushes to completely remove the contents from the toilet bowl, therefore, defeating the gains in efficiency by requiring multiple flushes to achieve proper flushing.

SUMMARY

At least one exemplary embodiment of the application relates to a toilet having an inlet structure, a bowl structure, and an outlet structure. The inlet structure is configured to receive water. The bowl structure has a toilet bowl including a rim and a sump, a split fluidly connected to the inlet structure and including a first passage and a second passage, a shelf located below the rim of the toilet bowl and fluidly connected to the first passage, a side channel fluidly connected to the second passage, and a diverter that redirects the water from the side channel to the sump of the toilet bowl. The outlet structure is fluidly connected to the sump and is configured to discharge water from the sump into a drain.

Another exemplary embodiment of the application relates to a toilet including an inlet structure, a bowl structure, and an outlet structure. The inlet structure includes an inlet for receiving water, a horizontal section, and an elbow fluidly connecting the inlet to the horizontal section. The elbow includes a breaking radius and has a circular cross sectional shape. The bowl structure includes a toilet bowl having a rim and a sump, a split located downstream of the horizontal section and having a first passage and a second passage, a shelf located below the rim and fluidly connected to the first passage, a side channel fluidly connected to the second passage, and a diverter that redirects the water from the side channel to an inlet opening into the sump. The outlet structure includes a trapway that is fluidly connected to the sump and has an outlet.

Another exemplary embodiment of the application relates to a toilet including a toilet bowl and a shelf. The toilet bowl includes a rim. The shelf is located below the rim and is spaced apart from the rim. Together, the rim and the shelf form an inset channel that extends along at least a portion of the perimeter of the toilet bowl. A height of the inset channel, between the rim and the shelf, decreases continuously in a flow direction.

DETAILED DESCRIPTION

Referring generally to the FIGURES, disclosed herein are toilets having a flush structure that improves the overall flush efficiency of the toilet. That is, the flush structure allows the toilet to properly flush the contents in the bowl using less water. For example, the toilets are configured to flush the contents in the bowl using a single flush containing one gallon or less of water per flush (1.0 gpf). In this way, the toilets of this application can completely remove the contents from the bowl using a single flush cycle of reduced volume, such as using 1.0 gpf or less of water.

Figure 1:
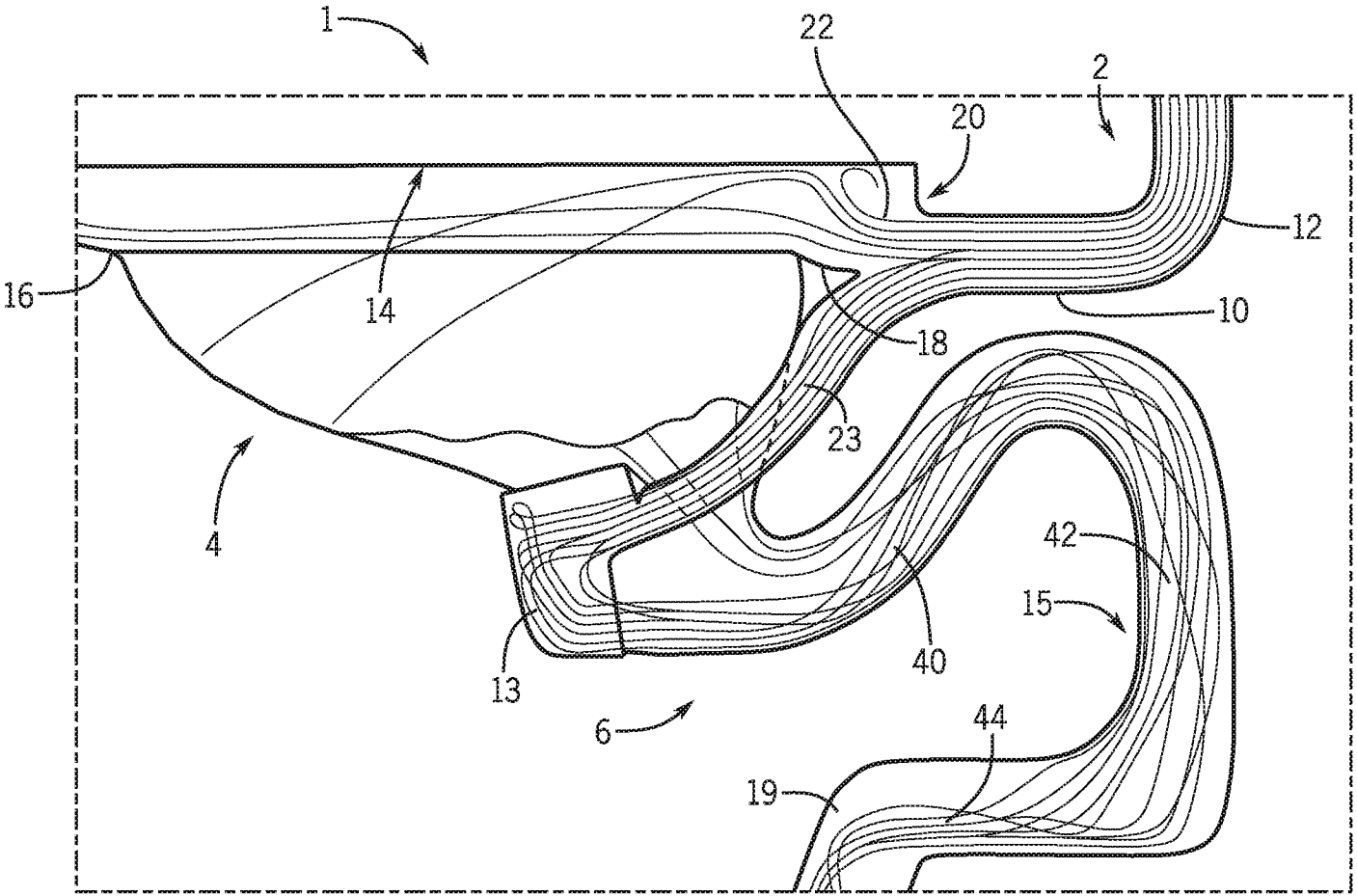
FIG. 1 is a side view of a toilet flush structure in a computational fluid dynamic (CFD) model illustrating velocity streamlines correlating to efficiency, according to an exemplary embodiment.
Figure 2:
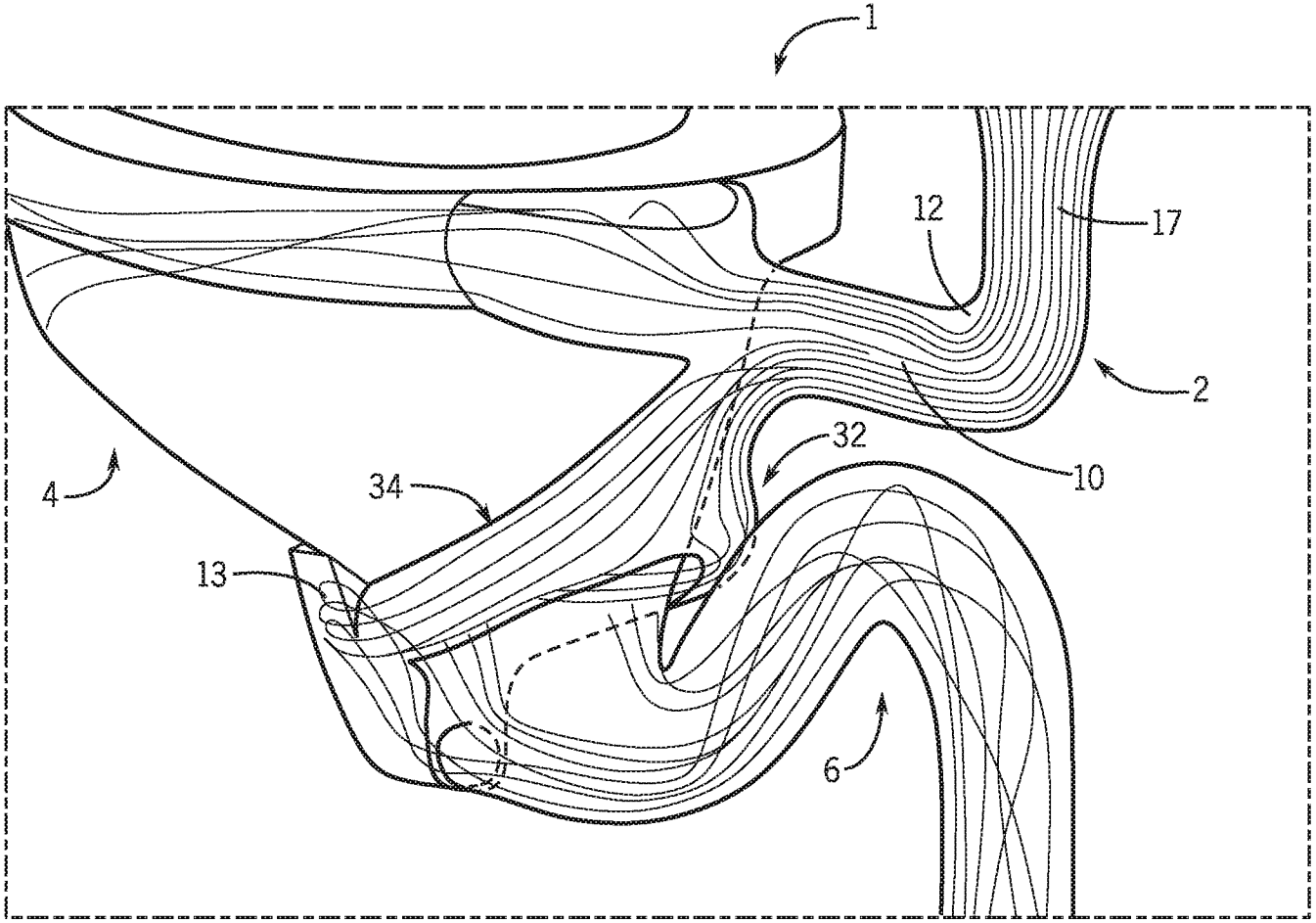
FIG. 2 is a rear perspective view of the toilet flush structure in the CFD model shown in FIG. 1.
Figure 3:
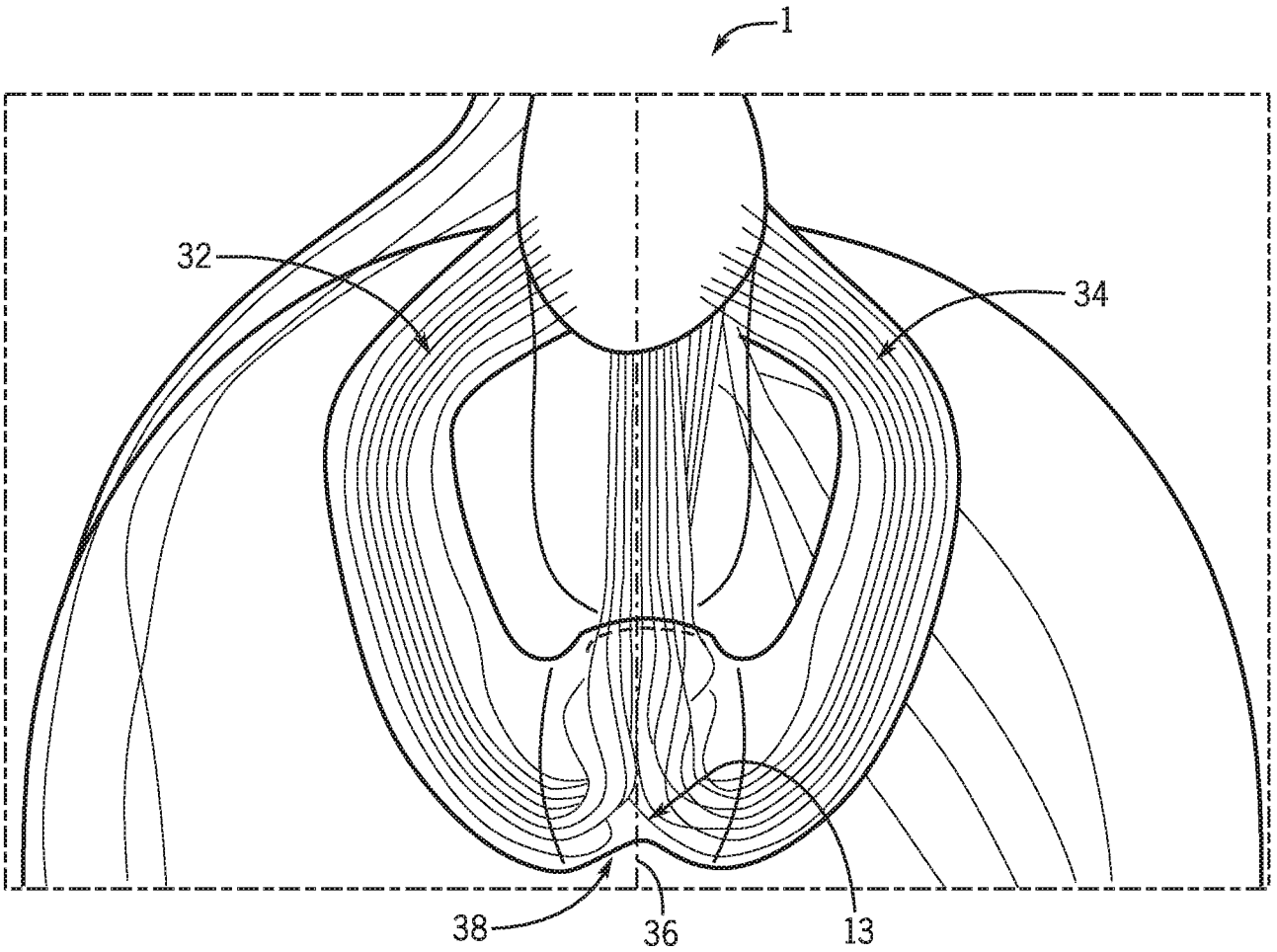
FIG. 3 is a bottom view of the toilet flush structure in the CFD model shown in FIG. 1.

FIGS. 1-3 illustrate an exemplary embodiment of a flush structure for a toilet 1 with streamlines (e.g., velocity streamlines) passing through the flush structure. The streamlines were modeled using a CFD model on a computer with the aim of evaluating the flush efficiency of the new structure, such as by comparing the streamlines to streamlines in other toilet flush structures. The CFD streamlines correlate to efficiency. For example, decreases in velocity streamlines can indicate drops/reductions in fluid pressure or energy, which is indicative of efficiency loss. Also, for example, swirling and turbulence of streamlines can indicate drops in fluid pressure or energy. By tailoring the flush structure to reduce the velocity drops and turbulence, the overall efficiency of the toilet flush system can be increased.

The illustrated flush structure includes an inlet structure 2, a bowl structure 4, and an outlet structure 6. The inlet structure 2 receives water from a source, such as a tank, and delivers water to the bowl structure 4. The bowl structure 4 is configured to direct the water received from the inlet structure 2 into the bowl to wash the contents in the bowl to an outlet of the toilet 1 as well as clean the inside (e.g., internal) surfaces of the bowl. The outlet structure 6 is configured to direct the water and the contents in the bowl from the toilet 1, such as to a drainpipe or other sewer line.

Figure 6:
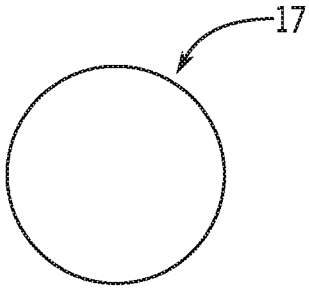
FIG. 6 is a cross sectional view of a drain cast inlet taken along line A-A in FIG. 1.
Figure 7:
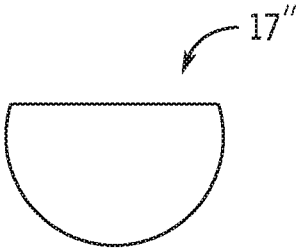
FIG. 7 is a cross sectional view of an alternative inlet.

The illustrated inlet structure 2 delivers flush water into the bowl structure 4 and includes an inlet 17 (shown in FIG. 2) that can interface with (or include) a flush valve (not shown), which controls the flow (e.g., volume and timing) of flush water into the inlet structure 2 upon activation of a flush cycle of the toilet 1. The illustrated inlet 17 extends generally downward (e.g., vertically) to an elbow 12 (shown in FIG. 1) having a breaking radius, which advantageously helps completely evacuate air, rather than a sharp break or turn, in which air gets trapped. As a non-limiting example, the breaking radius of the elbow 12 is approximately 0.75 inches (¾") at the inner radius. As shown, a horizontal section 10 (shown in FIG. 1) extends from the elbow 12 to the bowl structure 4. The illustrated cast inlet structure (e.g., the inlet 17 shown in FIG. 6) is configured having a generally circular cross-sectional shape, which improves flow efficiency over an inlet, such as the inlet 17" shown in FIG. 7, having a "U" or "D" cross-sectional shape, which current processes (e.g., manufacturing) necessitate. New processes, such as a "tile-on-rim" process allows the inlet structure (e.g., the inlet 17, the horizontal section 10, etc.) to have the generally circular shape. Further, the size (e.g., diameter) of the drain cast inlet structure can be reduced because of the efficiency gain and the circular cross-sectional shape. While the embodiment of FIGS. 1-3 illustrate a drain cast vitreous inlet structure, it is to be understood that other material and manufacturing processes are included in the scope of this disclosure.

Figure 5:
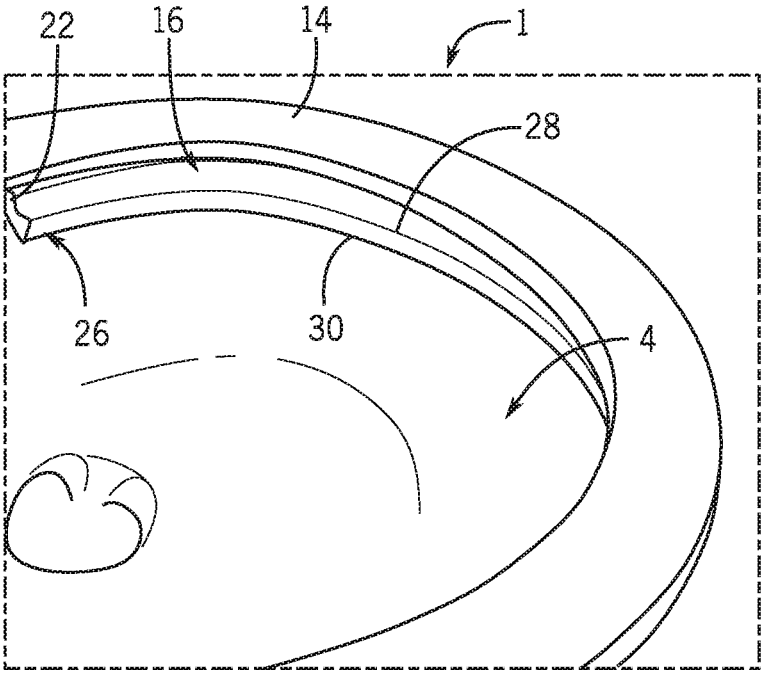
FIG. 5 is a perspective view of a portion of a shelf of the bowl.

The bowl structure 4 includes a split 20 (shown in FIG. 1) downstream from the horizontal section 10 of the inlet structure 2, where the split 20 includes a first passage 22 and a second passage 23. The first passage 22 (or upper passage) opens into a fluvial terrace or shelf 16 (also shown in FIGS. 1 and 5) that is located around an inside of a top of the bowl and underneath a rim 14 (shown in FIG. 5). The rim 14 does not include an enclosed rim channel, fluid channel, or other fluid delivery or water carrying feature. That is, the illustrated rim 14 is a solid, planar member that overhangs the shelf 16 (see FIG. 5). As shown in FIG. 5, the shelf 16 is configured to direct flush water in a single direction (e.g., clockwise or counterclockwise depending on the location of the shelf inlet 24) around the shelf 16 and the bowl resulting in a swirl flush. As shown in FIG. 5, the shelf 16 has a compound radius leading from the shelf inlet 24, where the compound radius includes an inner radius 28 and a radius 30 into the bowl. According to one example, the inner radius 28 is approximately 0.25 inches (¼") and the outer radius 30 into the bowl is approximately 0.75 inches (¾"), where each radius remains substantially constant around the bowl. The combination of the inner radius 28 and outer radius 30 (e.g., breaking radius) into the bowl along with the shelf width combine to define variable water shed rate around the perimeter of the toilet 1. Further, the shelf 16 is elevated in the bowl relative to the first passage 22 or upper passage (e.g., a central axis of the first passage 22). That is, the water feed 18 (shown in FIG. 1) from the first passage 22 to the shelf 16 slopes upwardly moving forward/downstream from the first passage 22 to the shelf 16. This advantageously prevents refill water from entering the bowl through the shelf 16, especially when the refill water continues to run such as from a leaking valve, which eliminates stains or streaking in the bowl under the shelf 16 from the excess refill water. Instead, any excess refill water drains into the second passage 23 and into the sump through an opening therein.

The bowl structure 4 including the shelf 16 is configured to maximize coverage of the internal or inside surfaces of the bowl with water during a flush cycle while using as little water as possible during each flush cycle. According to one example, the toilet 1 is configured to divert approximately 15-30% of the total flush water (e.g., 0.15-0.30 gallons for a 1 gal. flush) to the first passage 22 (e.g., the upper passage). Sending less than 15% of the total flush water through an enclosed rim channel (for other toilets) or an upper passage (e.g., for the toilets of this application) can lead to less than desirable (e.g., intermittent) coverage of the inside surfaces of the bowl, whereas sending too much (e.g., 50% or more) water through the rim or upper passage can lead to poor overall flush performance.

As shown in FIG. 1, the second passage 23 (e.g., the lower passage) opens into a lower part (e.g., the sump) of the bowl after passing through one or more side channels and a diverter 13 in the sump or "pug" of the toilet bowl. As shown best in FIGS. 2 and 3, the illustrated toilet (e.g., bowl structure) includes a two channel structure having a right side channel (RSC) 32 that extends from the split 20 downwardly around a right side of the bowl and a left side channel (LSC) 34 that extends from the split 20 downwardly around a left side of the bowl. Thus, each side channel of the RSC 32 and LSC 34 does not extend within or inside the bowl, but rather around an outside of the bowl. As shown in FIG. 3, each side channel has a somewhat arcuate shape (when viewed from underneath) and the RSC 32 and the LSC 34 are symmetrically opposite about a central longitudinal axis 36 (e.g., through the opening into the bowl from the diverter 13). A single channel toilet can include either the RSC 32 or LSC 34. According to one example, the toilet 1 is configured to divert approximately 60-75% of the total flush water (e.g., 0.60-0.75 gallons for a 1 gal. flush system) to the second passage 23 (e.g., the lower passage) and through the one or more side channels.

Figure 4:
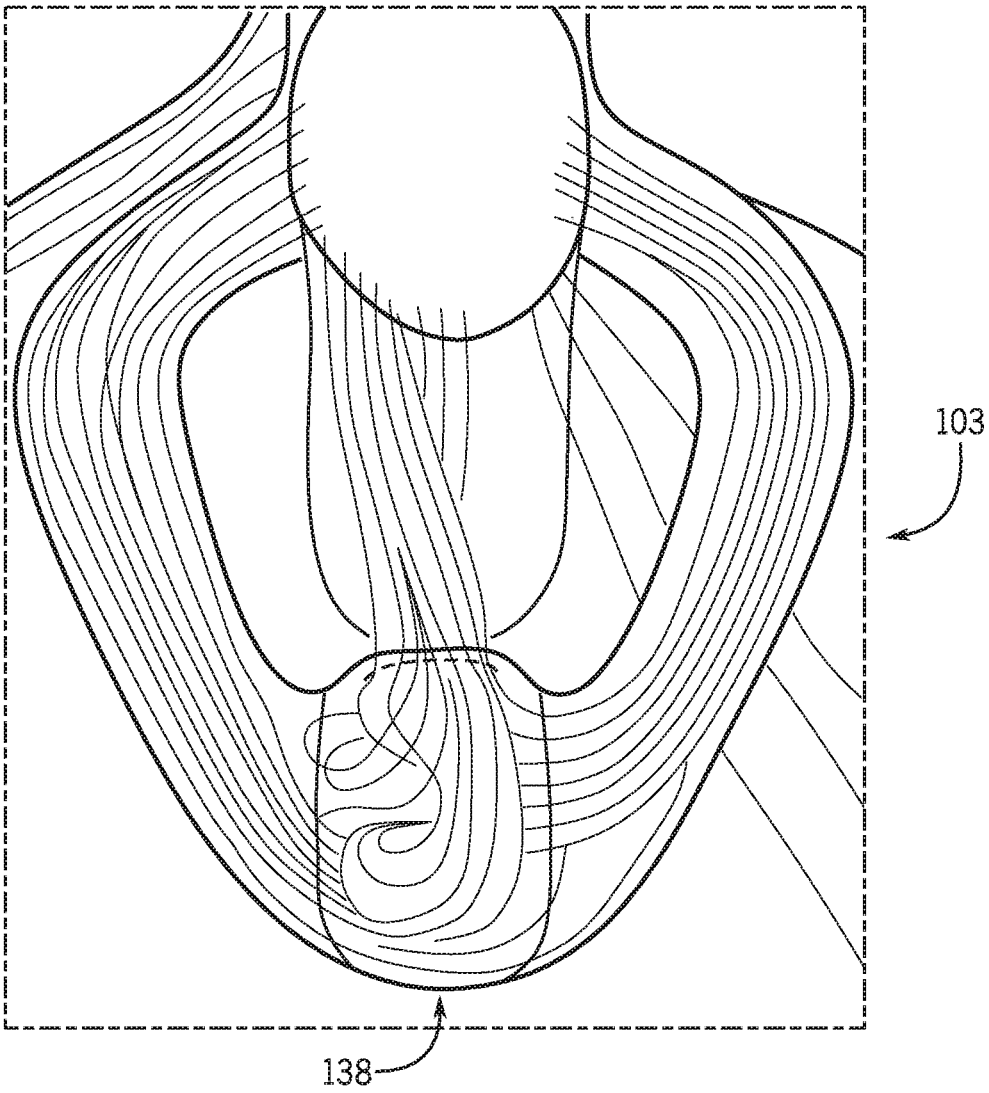
FIG. 4 is a bottom view of another toilet flush structure in a CFD model, according to an exemplary embodiment.

The diverter 13 (e.g., diverter plate) shown in FIG. 3 is configured to re-converge the water from the RSC 32 and the LSC 34 prior to the water entering the sump of the bowl through a lower opening (e.g., sump jet, sump opening, etc.) into the bowl. That is, the diverter 13 takes the two circular flows through the RSC 32 and the LSC 34 and converges the two flows into a single straight flow into the bowl. As shown in FIG. 3, the diverter 13 includes an inward (e.g., concave) projection 38 or indentation at the front of the diverter 13, which forms a general "W" shape with the RSC 32 and the LSC 34 and the lower opening into the sump. This arrangement reduces swirling and turbulence of the converging streamlines, as compared to, for example, the design (e.g., toilet 103) shown in FIG. 4 having a rounded front 138 with no indentation, which results in significant swirling and turbulence that lead to energy loss resulting in a reduced flush efficiency.

Returning to FIG. 1, the outlet structure 6 from the bowl includes a trapway 15 having a variable size (e.g., diameter)

along a length. The trapway 15 includes an upleg 40 that extends upwardly and rearwardly from the sump of the bowl to a weir or dam, a downleg 42 that extends downwardly from the dam, and an outleg 44 that extends forward from a downstream end of the downleg 42 to an outlet 19 of the toilet. According to one example, the upleg 40 of the trapway 15 has a generally common size (e.g., a diameter of 2.125 inches), the downleg 42 and outleg 44 of the trapway 15 each have a generally common size (e.g., a diameter of 2.000 inches or less), and the outlet 19 has a diameter of 2.00-2.50 inches. The illustrated outlet 19 is shown extending forward and downward at an angle of 10-20° (ten to twenty degrees). This variable size arrangement of the trapway 15 is configured to set up a siphon quicker, as well as provide faster priming and a quicker, longer siphon during each flush cycle. Further, the outlet 19 configuration increases the discharge flow rate by 15% or more. For comparison, a 90° (ninety degrees) turn (at the outlet) leads to water impacting the wall of the trapway and results in energy loss during the flush cycle.

The geometry and arrangement of inlet structure, the bowl structure, and the outlet structure are provided for illustrative purposes only. It will be appreciated that various alternatives and combinations are possible without departing from the inventive concepts disclosed herein. For example, in some exemplary embodiments, the geometry of the shelf and/or rim may be modified to further improve flushing efficiency. FIGS. 8-11 show a toilet 200 including a variable height swirl flush rim structure, shown as rim structure 202, according to an exemplary embodiment. In other embodiments, the rim structure 202 may be incorporated as part of the toilet 1 of FIGS. 1-3.

Figure 8:
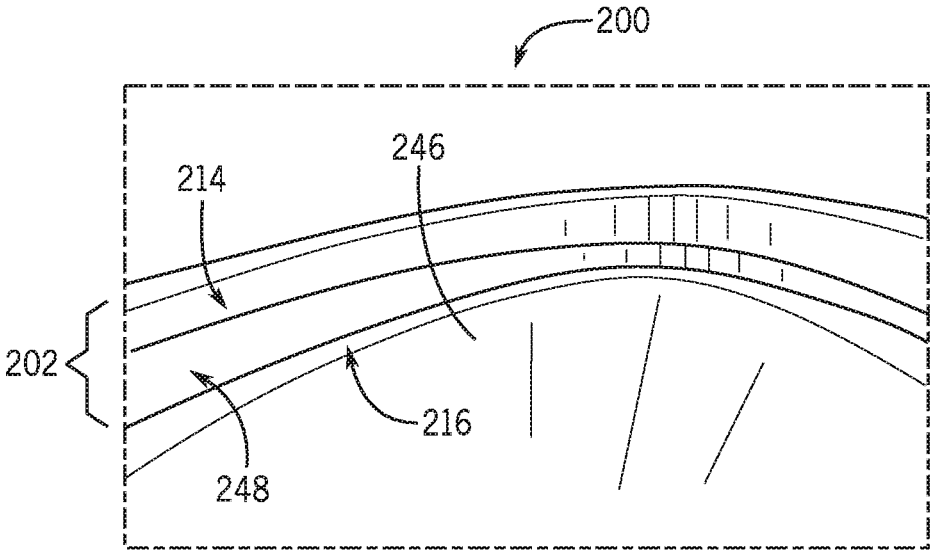
FIG. 8 is a top perspective view of a toilet including a swirl flush rim structure, according to an exemplary embodiment.

As shown in FIG. 8, the rim structure 202 includes a shelf 216 (e.g., fluvial terrace, lower ledge, etc.) that is located along an upper region of the toilet bowl, along an upper portion of a waste receiving surface 246 of the toilet bowl. Additionally, the rim structure 202 includes a rim 214 (e.g., a ceiling, etc.) disposed at a top of the toilet bowl, above the shelf 216. The rim 214 forms an upper surface of the toilet bowl. The rim 214 extends inwardly from an outer perimeter of the toilet bowl, such that is overhangs the shelf 216. Together, the shelf 216 and the rim 214 form an inset channel 248 that extends along a perimeter of the toilet bowl (e.g., the waste receiving surface 246).

Figure 9:
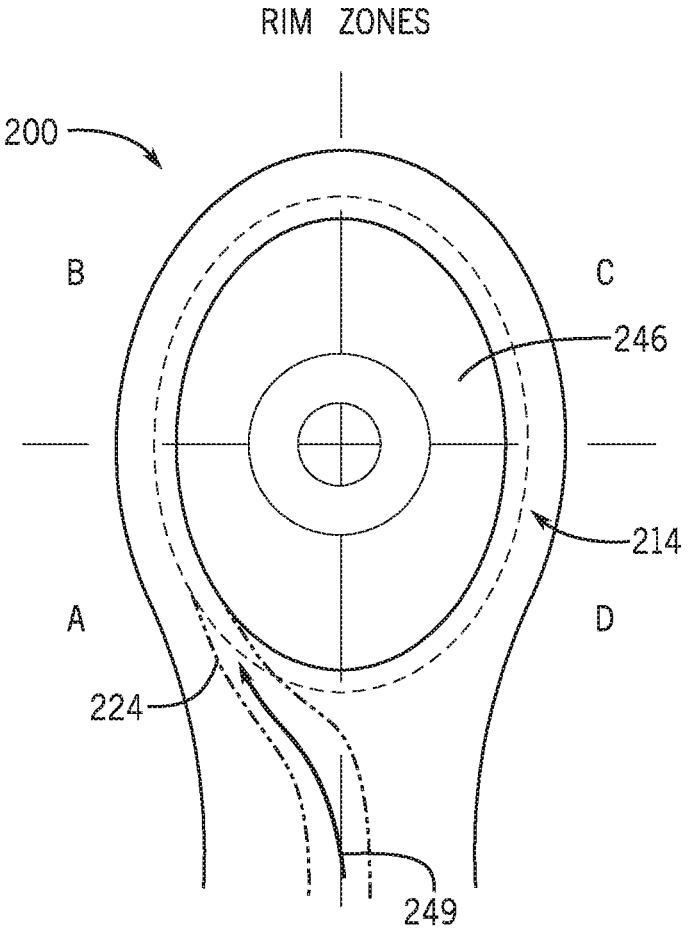
FIG. 9 is a top view of the toilet of FIG. 8.

The shelf 216 is configured to direct flush water in a single direction (e.g., clockwise or counterclockwise depending on the direction in which water is received within the shelf 216) around the shelf 216 and the perimeter of the waste receiving surface 246, resulting in a swirl or vortex flow pattern (i.e. a swirl flush). In various exemplary embodiments, the shelf 216 has a compound radius, which may be the same or similar to that described for the toilet 1 of FIGS. 1-3. As shown in FIG. 9, the toilet 200 further includes a shelf inlet 224, which is configured to direct water from at least one of a flush tank of the toilet 200 (not shown) or a water supply line connected to an inlet of the toilet 200 to the inset channel 248. For example, the shelf inlet 224 may form part of a first passage (e.g., upper passage) that extends downstream from an inlet structure of the toilet 200 as described with reference to the toilet 1 of FIGS. 1-3.

Figure 10:
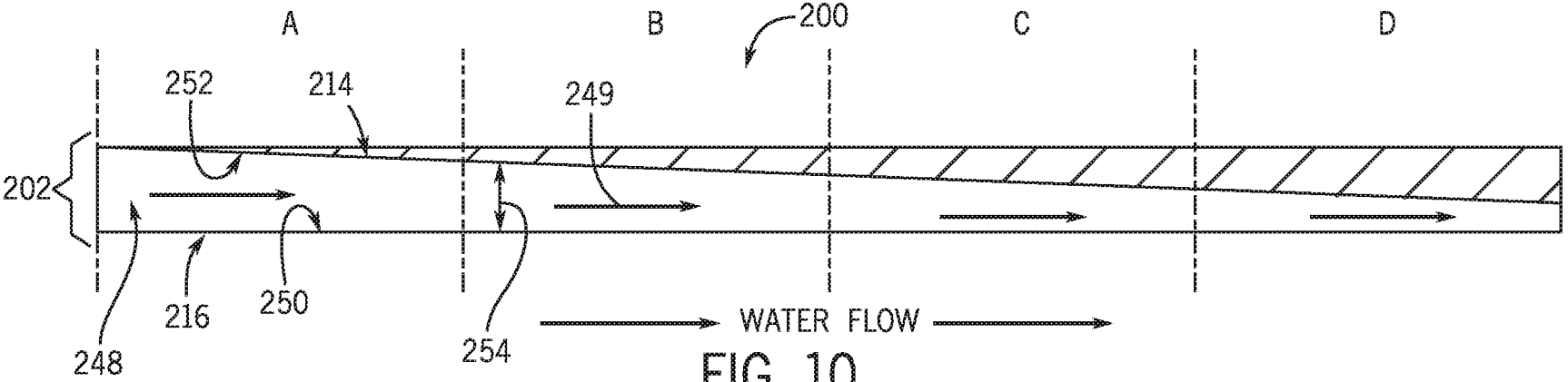
FIG. 10 is a panoramic view of the swirl flush rim structure of the toilet of FIG. 8.

The rim structure 202 is configured to improve water coverage along a perimeter of the toilet bowl during a flush, without increasing the amount of water provided to the inset channel 248 via the shelf inlet 224. FIG. 9 shows a top view of the toilet 200 in which the rim structure 202 has been separated into sections along the perimeter of the toilet bowl, each forming ¼ portion of the overall perimeter of the toilet bowl. Water enters the inset channel 248 at section A through the shelf inlet 224 and flows along the perimeter from A to sections B, C, and D, sequentially (e.g., clockwise, etc.). FIG. 10 shows a panoramic side view from inside the toilet bowl, in the area of the inset channel 248. As shown in FIGS. 8 and 10, a height of the inset channel 248, between the rim 214 and the shelf 216, varies continuously along the length of the inset channel 248 (e.g., along a perimeter of the waste receiving surface 246). In particular, the height of the inset channel 248 decreases continuously along the length of the inset channel 248 in a flow direction 249 along the length of the inset channel 248. As shown in FIG. 10, an upper surface 250 of the shelf 216 is substantially horizontal (e.g., is equidistant from the sump of the toilet bowl along a perimeter of the waste receiving surface 246). A lower surface 252 of the rim 214 is sloped downwardly (e.g., tapered), toward the shelf 216, such that the lower surface 252 of the rim 214 and the upper surface 250 of the shelf 216 converge toward one another in the flow direction 249. In other embodiments, the shelf 216 may slope upwardly toward the rim 214 along the length of the inset channel 248 in the flow direction 249. In yet other embodiments, both the rim 214 and the shelf 216 may slope toward one another (e.g., the rim 214 and the shelf 216 may both be angled relative to a horizontal plane extending through the toilet bowl and/or an upper surface of the toilet bowl/rim 214). In various exemplary embodiments, a height 254 of the inset channel 248, between the rim 214 and the shelf 216, may vary within a range between approximately 0.5 inches and 1 inch.

Figure 12:
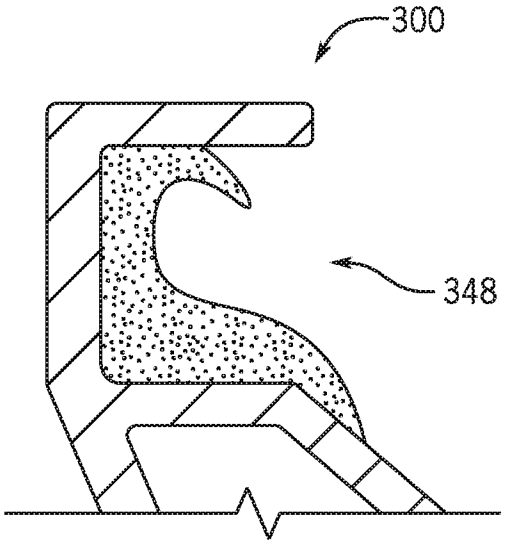
FIG. 12 is a side cross sectional view of a rim area for a toilet that has a constant height along a perimeter of the toilet, according to an exemplary embodiment.
Figure 11:
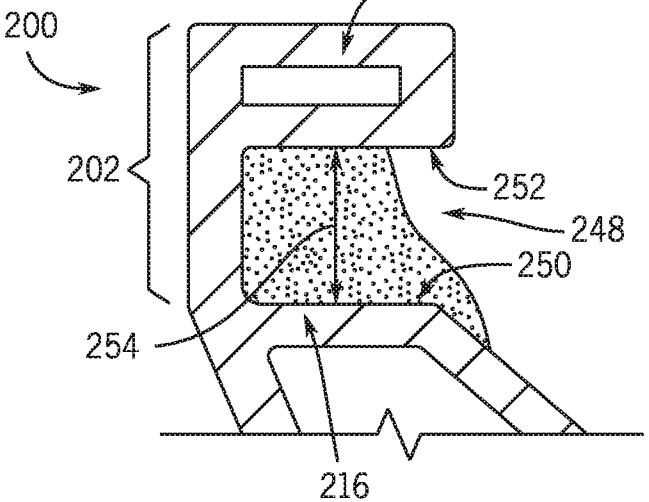
FIG. 11 is a side cross sectional view of the toilet of FIG. 8 in the area of the swirl flush rim structure.
Figure 13:
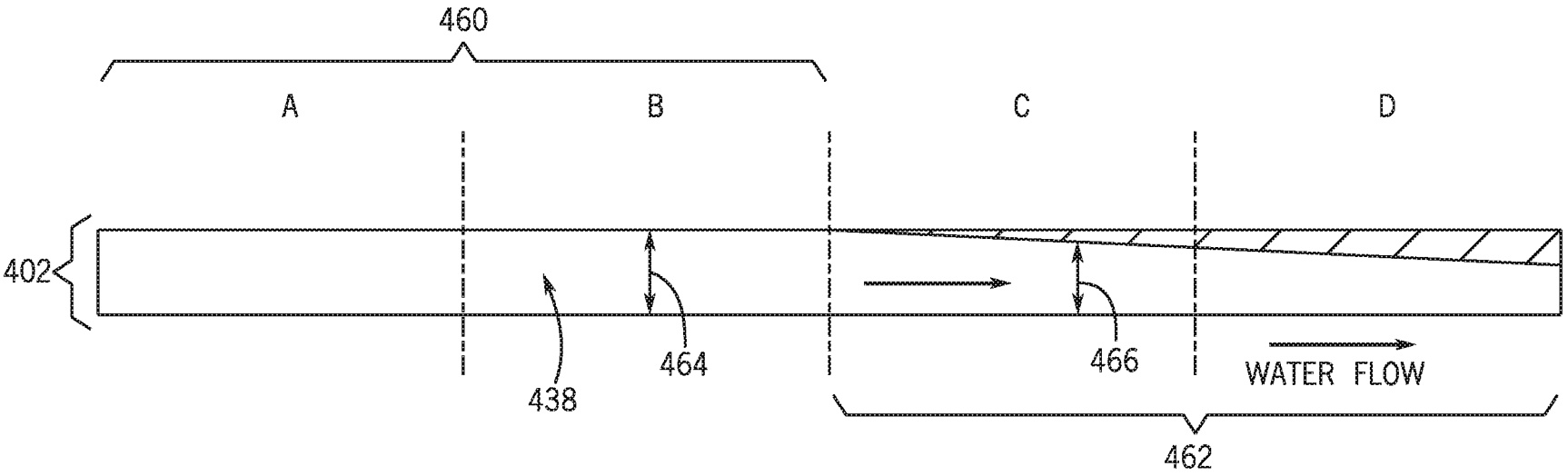
FIG. 13 is a panoramic view of a swirl flush rim structure for a toilet, according to another exemplary embodiment.

FIG. 11 shows a cross sectional view through the inset channel 248 during a flush operation. FIG. 12 shows a cross sectional view through an inset channel 348 of another a toilet 300, in which the height of the inset channel 348 (between the rim and the shelf) is constant along the perimeter of the toilet bowl. The height 254 of the inset channel 248 of the toilet 200 of FIG. 11, at any position along the perimeter of the toilet bowl, may be less than the height of the inset channel 348 of the toilet 300 of FIG. 12. According to various exemplary embodiments, the heights may differ by a factor of two or greater. Among other benefits, reducing the height of the inset channel 248 reduces the vertical space that the water can flow upwardly along an inner surface 256 of the inset channel 248, which reduces fluid losses in the direction of flow (compare, e.g., FIG. 11 to FIG. 12, where FIG. 12 illustrates that the water flow forms a "wave" shape with the upper portion of the water cresting over and back onto itself, which illustrates lost energy in the flow during its flow around the perimeter). This limits the amount of fluid energy that is lost from water flowing vertically within the inset channel 248, thereby allowing the fluid to move a longer distance through the inset channel 248 before flowing downwardly along the waste receiving surface 246 toward the sump of the toilet bowl. The reduction in fluid losses along the inset channel 248 is accompanied by a reduction in the amount of fluid required to sustain full 360° vortex (e.g., swirl) along the perimeter of the toilet bowl (e.g., along the inset channel 248). At least some of the benefits observed for the toilet 200 of FIGS. 8-11 may also be realized by selectively reducing the height of the inset channel within certain regions along the perimeter of the toilet bowl; for example, by selectively reducing the height of the inset channel beginning at, and following, a sharp curve along the perimeter of the toilet bowl such as in an area near the front of the toilet bowl. FIG. 13 shows an example of an inset channel 438 of another rim structure 402, according to an exemplary embodiment. As shown in FIG. 13, the inset channel 438 includes two portions, a first portion 460 that extends between the shelf inlet (on the left of segment A) and a forward region through a central axis through the toilet bowl (between segments B and C), and a second portion 462 that extends between the forward region and a downstream end of the inset channel 438 (between segments D and A). A height 464 of the first portion 460 is approximately constant along the length of the first portion 460, while a height 466 of the second portion 462 decreases continuously along the length of the second portion 462.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the toilets and the components/elements, as shown in the various exemplary embodiments, are illustrative only. Additionally, any element disclosed in one embodiment may be incorporated or utilized with any other embodiment disclosed herein. For example, each inlet structure or component thereof, each bowl structure or component thereof, and/or each outlet structure or component thereof described herein may be incorporated into any other embodiment of this application. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A toilet, comprising:

an inlet structure configured to receive water;

a bowl structure, comprising:

a toilet bowl comprising a rim and a sump;

a split fluidly connected to the inlet structure, the split comprising a first passage and a second passage, the split dividing water flowing from a horizontal section into the first passage and the second passage;

a shelf located below the rim and fluidly connected to the first passage;

a plurality of side channels connected to the second passage, the plurality of side channels including a first side channel and a second side channel, wherein the first side channel extends from the split downwardly around a first side of the toilet bowl, wherein the second side channel of the plurality of side channels extends from the split downwardly around a second side of the toilet bowl opposite the first side;

a diverter that redirects the water from the side channel to the sump; and an outlet structure fluidly connected to the sump and configured to discharge water from the sump into a drain, wherein together the rim and the shelf form an inset channel that extends along a perimeter of the toilet bowl in a single flow direction and is open to a waste receiving surface of the toilet bowl, and wherein a thickness of the rim increases so that a lower surface of the rim slopes downwardly toward the shelf so that a height of the inset channel, between the rim and the shelf, decreases in the single flow direction to reduce fluid losses in the single flow direction.

2. The toilet of claim 1, wherein each of the plurality of side channels has an arcuate shape, and wherein the first side channel and the second side channel are symmetric with one another about a central longitudinal axis through the toilet bowl.

3. The toilet of claim 1, wherein the diverter comprises an inward indentation between the first side channel and the second side channel, and wherein the inward indentation forms a "W" shape.

4. The toilet of claim 1, wherein the inlet structure comprises an inlet for receiving water, the horizontal section, and an elbow fluidly connecting the inlet and the horizontal section, and wherein the elbow has a breaking radius and a circular cross sectional shape.

5. The toilet of claim 1, wherein the outlet structure comprises a trapway fluidly connected to the toilet bowl, wherein the trapway comprises an upleg that extends upwardly and rearwardly from the sump of the toilet bowl to a dam, a downleg that extends downwardly from the dam, and an outleg that extends forward from a downstream end of the downleg to an outlet of the toilet.

6. The toilet of claim 5, wherein the upleg of the trapway has a larger diameter than both the downleg and the outleg, and wherein the downleg and the outleg are the same diameter.

7. The toilet of claim 1, wherein the height of the inset channel decreases at a constant rate along an entire length of the inset channel.

8. The toilet of claim 1, wherein the bowl structure further comprises a water feed located between the first passage and the shelf, and wherein the water feed slopes upwardly moving downstream from the first passage to the shelf, such that the shelf is elevated relative to a central axis of the first passage.

9. A toilet, comprising:

an inlet structure comprising an inlet for receiving water, a horizontal section, and an elbow fluidly connecting the inlet to the horizontal section, the elbow comprising a breaking radius and having a circular cross sectional shape;

a bowl structure comprising a toilet bowl having a rim and a sump, a split located downstream of the horizontal section and having a first passage and a second passage, the split dividing water flowing from the horizontal section into the first passage and the second passage, a shelf located below the rim and fluidly connected to the first passage;

a plurality of side channels connected to the second passage, the plurality of side channels including a first side channel and a second side channel, wherein the first side channel extends from the split downwardly around a first side of the toilet bowl, wherein the second side channel of the plurality of side channels extends from the split downwardly around a second side of the toilet bowl opposite the first side, and a diverter that redirects the water from the side channel to an inlet opening into the sump; and an outlet structure comprising a trapway that is fluidly connected to the sump and has an outlet, wherein together the rim and the shelf form an inset channel that extends along a perimeter of the toilet bowl in a single flow direction and is open to a waste receiving surface of the toilet bowl, and wherein a thickness of the rim increases so that a lower surface of the rim slopes downwardly toward the shelf so that a height of the inset channel, between the rim and the shelf, decreases in the single flow direction to reduce fluid losses in the single flow direction.

10. The toilet of claim 9, wherein each of the plurality of side channels has an arcuate shape, and wherein the first side channel and the second side channel are symmetric with one another about a central longitudinal axis through the toilet bowl.

11. The toilet of claim 9, wherein the diverter comprises an inward indentation between the first side channel and the second side channel, and wherein the inward indentation forms a "W" shape.

12. A toilet, comprising:

an inlet structure configured to receive water;

a toilet bowl comprising a rim;

a split fluidly connected to the inlet structure, the split comprising a first passage and a second passage, the split dividing water flowing from a horizontal section into the first passage and the second passage;

a plurality of side channels connected to the second passage, the plurality of side channels including a first side channel and a second side channel, wherein the first side channel extends from the split downwardly around a first side of the toilet bowl, wherein the second side channel of the plurality of side channels extends from the split downwardly around a second side of the toilet bowl opposite the first side;

a shelf located below the rim and spaced apart from the rim, the rim and the shelf forming an inset channel that extends along a perimeter of the toilet bowl, wherein a height of the inset channel, between the rim and the shelf, decreases continuously in a single flow direction, wherein the inset channel that extends along the perimeter of the toilet bowl is open to a waste receiving surface of the toilet bowl, and wherein a thickness of the rim increases so that a lower surface of the rim slopes downwardly toward the shelf so that a height of the inset channel, between the rim and the shelf, decreases in the single flow direction to reduce fluid losses in the single flow direction.

13. The toilet of claim 12, wherein the height of the inset channel decreases at a constant rate along an entire length of the inset channel.

14. The toilet of claim 1, wherein the single flow direction is clockwise.

15. The toilet of claim 1, wherein the single flow direction is counterclockwise.

* * * * *